US005146630A

United States Patent [19]

Richard

[11] Patent Number: 5,146,630

[45] Date of Patent: Sep. 15, 1992

[54] SWEATBAND

[75] Inventor: Raymond J. Richard, Bradenton, Fla.

[73] Assignee: Ray-Ed Products, Sarasota, Fla.

[21] Appl. No.: 680,093

[22] Filed: Apr. 3, 1991

[51] Int. Cl.[5] ..... A42C 5/02; A42B 1/24

[52] U.S. Cl. ..... 2/181; 2/171.2; 2/247; 2/DIG. 11

[58] Field of Search ..... 2/181, DIG. 11, 171, 2/171.2, 181.4, 411, 422, 171.4, 171.8, 183, 247, 209.3

[56] References Cited

U.S. PATENT DOCUMENTS

| | | | |
|---|---|---|---|
| 1,434,854 | 11/1922 | Stall | 2/181 |
| 1,689,539 | 10/1928 | Wagner | 2/181 |
| 1,889,913 | 12/1932 | Birum . | |
| 2,223,332 | 11/1940 | Sterne | 2/171 |
| 2,265,530 | 12/1941 | Kleinman | 2/181 |
| 2,364,839 | 12/1944 | Young | 112/2 |
| 2,698,838 | 1/1955 | Simon | 260/2.5 |
| 2,702,067 | 2/1955 | Goldberg | 154/1.8 |
| 2,783,474 | 3/1957 | Campagna et al. | 2/171 |
| 2,965,574 | 12/1960 | Tierney | 252/78 |
| 2,965,584 | 12/1960 | Elkin | 2/181 |
| 3,007,207 | 11/1961 | Salhofer | 18/57 |
| 3,089,146 | 5/1963 | Sterne | 2/181 |
| 4,277,847 | 7/1981 | Florio | 2/DIG. 11 |
| 4,449,977 | 5/1984 | Korpman | 604/366 |
| 4,502,156 | 3/1985 | Wishman | 2/DIG. 11 |
| 4,675,915 | 6/1987 | Siciliano | 2/DIG. 11 |
| 4,742,581 | 5/1988 | Rosenthal | 2/181 |
| 4,768,503 | 9/1988 | Highgate et al. | 604/336 |
| 4,776,042 | 10/1988 | Hanson et al. | 2/DIG. 11 |
| 4,811,430 | 3/1989 | Janusz | 2/DIG. 11 |
| 4,815,144 | 3/1989 | Martin | 2/171.2 |
| 4,856,116 | 8/1989 | Sullivan | 2/181 |

FOREIGN PATENT DOCUMENTS

| | | | |
|---|---|---|---|
| 3620506 | 6/1987 | Fed. Rep. of Germany | 2/DIG. 11 |

*Primary Examiner*—Werner H. Schroeder
*Assistant Examiner*—Amy Brooke Varatta
*Attorney, Agent, or Firm*—Frijouf, Rust & Pyle

[57] ABSTRACT

An improved sweatband is disclosed comprising a first fabric configured to fit about the head of a wearer. A second fabric is attached to the first fabric and a third fabric is partially secured to the second fabric thereby forming a pocket therebetween. A removable package for holding granular moisture absorbing material is configured to fit withnin the pocket. The sweatband is secured to head of the wearer to absorb perspiration. The removable package can be removed and dried upon saturation of the granular moisture absorbing material.

8 Claims, 4 Drawing Sheets

SWEATBAND

BACKGROUND OF THE INVENTION

1. Field of the Invention

This invention relates to a headband, and more particularly, to a sweatband having a removable package containing hydrophilic granular material which absorbs perspiration secreted by the sweat glands onto the forehead of a person.

2. Background of the Invention

Various types of headbands or sweatband have been devised in the prior art for absorbing perspiration secreted by the sweat glands onto the forehead of a person.

U.S. Pat. No. 1,689,539 teaches a hat pad comprising a cloth pad positioned between a band and the inner side of the hat crown. The cloth pad includes pockets for retaining a substance, such as diatomaceous earth, for absorbing moisture and oil.

U.S. Pat. No. 2,223,332 teaches a sweatband consisting of an endless elastic band, for encircling the head of a wearer, and a rectangular pad secured thereto such that the pad is adjacent to the skin of the wearer and overlaps the elastic band to allow the pad to expand and contract independently of the band.

U.S Pat. No. 2,265,530 teaches a sweatband having a waterproof material stitched to a strip of leather with an absorbent wick material disposed between the waterproof material and leather. The wick extends away from the band to absorb moisture.

U.S. Pat. No. 2,783,474 teaches a fibrous and absorbent perspiration pad with perforations into which an elastic band may be secured to hold the sweatband on the forehead of a wearer.

U.S. Pat. No. 3,089,146 teaches a sweatband utilizing cellulose sponge granules within facing strips of a material, such as cheesecloth or gauze, for absorbing sweat secreted on to the skin and evaporating the absorbed sweat back into the atmosphere to provide an evaporative cooling effect.

U.S. Pat. No. 4,502,156 teaches a particular fabric for absorbing moisture for use in sweatband, diaper, headband etc. structures. The fabric consists of fused fibers on one side and unfused fibers on the opposite side.

U.S Pat. No. 4,815,144 teaches headware having freezable liquid or gel in a pouch which is positioned in a drain channel to collect the condensate.

Although the above prior art has made contribution in the art, the above prior art fails to provide a sweatband which extends the absorption capacity of the sweatband.

Therefore, it is an object of the present invention to provide an improved sweatband for the head which provides a moisture absorbing granular material housed in a removable package.

It is a further object of the present invention to provide a head sweatband which may be easily secured about the head of a wearer.

It is a further object of the present invention to provide a head sweatband which can be readily divided into separate parts with a first part being a head encircling part and the second part being a moisture absorbing part to speed the drying of the headband.

It is a further object of the present invention to provide a sweatband which enables the use of a moisture absorbing granular material which swells upon absorbing moisture by providing a securing means which cooperates with the surface areas of the first fabric and second fabric to enable swelling of the granular material during absorption of moisture while maintaining the tension necessary to hold the sweatband to the head of the wearer in a continuously comfortable manner before and during the absorption process.

It is a further object of the present invention to provide a removable package which enables the wearer to remove the package containing the moisture absorbing granular material when the moisture absorbing granular material no longer absorb moisture, to dry the fabric of the package and the absorbent material contained in the package and to insert a package containing dry granules of moisture absorbing material into the opening formed in the pocket of the headband.

It is a further object of the present invention to provide a sweatband using a removable package which when saturated with sweat may be dried and reused.

It is an advantage of the present invention to provide a renewable means for keeping excess sweat out of the eyes of a jogger or the like thereby assisting in maintaining clear vision during such exercise.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an relates to an improved sweatband comprising a first fabric having an elongated rectangular shape which is configured to fit about the head of a wearer. A second fabric having an elongated rectangular shape is likewise configured to fit about the head of the wearer. The periphery of the first fabric is attached to the periphery of the second fabric by stitching or the like. A third fabric having an elongated rectangular shape is configured to extend along the forehead of a wearer. The periphery of the third fabric is partially secured to the second fabric thereby forming a pocket having an opening to permit access into the pocket. A securing means is employed to secure the fabrics to the head of the wearer such that one of the first and the third fabrics is pressed against the forehead of the wearer by tension generated by the securing means.

The improved sweatband comprises a removable package for holding granular moisture absorbing material which is capable of being regenerated after absorption of a liquid. The removable package has an elongated rectangular shape which is configured to fit within the pocket such that upon saturation of the granular moisture absorbing material with absorbed moisture, the package may be removed from the pocket by way of the opening to enable the granular moisture absorbing material to be regenerated by drying or the like and to permit replacement of the removable package with a removable package having dry granular moisture absorbing material.

Preferably, the securing means comprises hooks and loops which are operatively positioned on the ends of the fabric such that the hooks and loops link together to secure the sweatband to the head of the wearer. The hooks and loops are more commonly known under the Trademark "VELCRO". Other securing means such as an elastic band, a cord capable of being tied about the head of the wearer or the like may be incorporated into the invention.

Preferably the removable package includes a hanging means for suspending the package during regeneration of the granular moisture absorbing material from a sweat or moisture saturated condition to a dry condition. The usual method of regenerating the granular moisture absorbing material is to air-dry the removable package by hanging the removable package in a low humidity environment.

The preferred embodiment of the present invention comprises a first elongated rectangular fabric configured to fit about the head of the wearer. A second elongated rectangular fabric is also configured to fit about the head of the wearer. The periphery of the first fabric is attached to the periphery of the second fabric by stitching or the like. A third elongated rectangular fabric is configured to extend along the forehead of the wearer. The periphery of the third elongated rectangular fabric is partially secured to the second fabric to form a pocket having an opening to permit access into the pocket. A securing means of hooks and loops (VELCRO) is employed for securing the fabrics to the head of the wearer such that one of the first and the third fabrics is pressed against the forehead of the wearer by tension generated by the securing means on the fabrics. A removable and elongated rectangular shape package for holding hydrophilic polymeric granules for absorbing moisture is configured to fit within the pocket such that upon saturation of the granular polymeric material with absorbed moisture, the package may be removed from the pocket by way of the opening to enable the granular polymeric material to be dried and to permit replacement of the removable package with a removable package having dry granular polymeric material. The removable package further includes a hanging means for suspending the package in order to promote the drying of the granular material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several figures of the drawings.

DETAILED DISCUSSION

Figure 1:
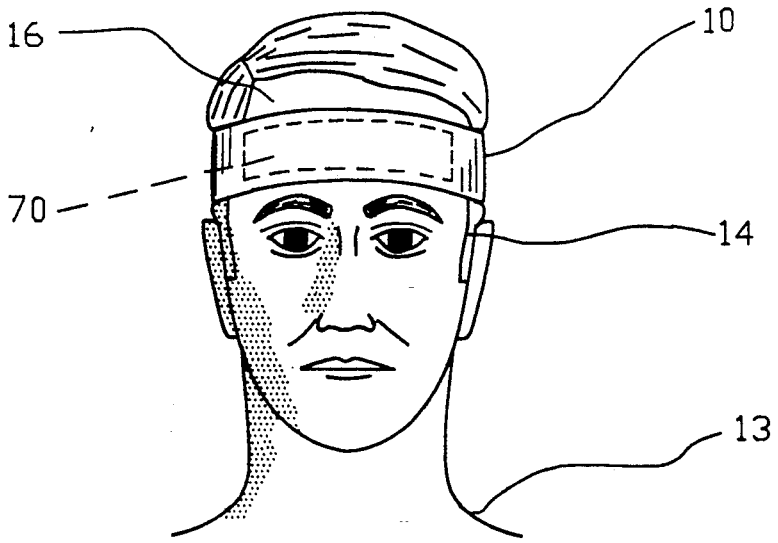
FIG. 1 illustrates a first embodiment of a sweatband of the present invention secured to the head of a wearer.
Figure 2:
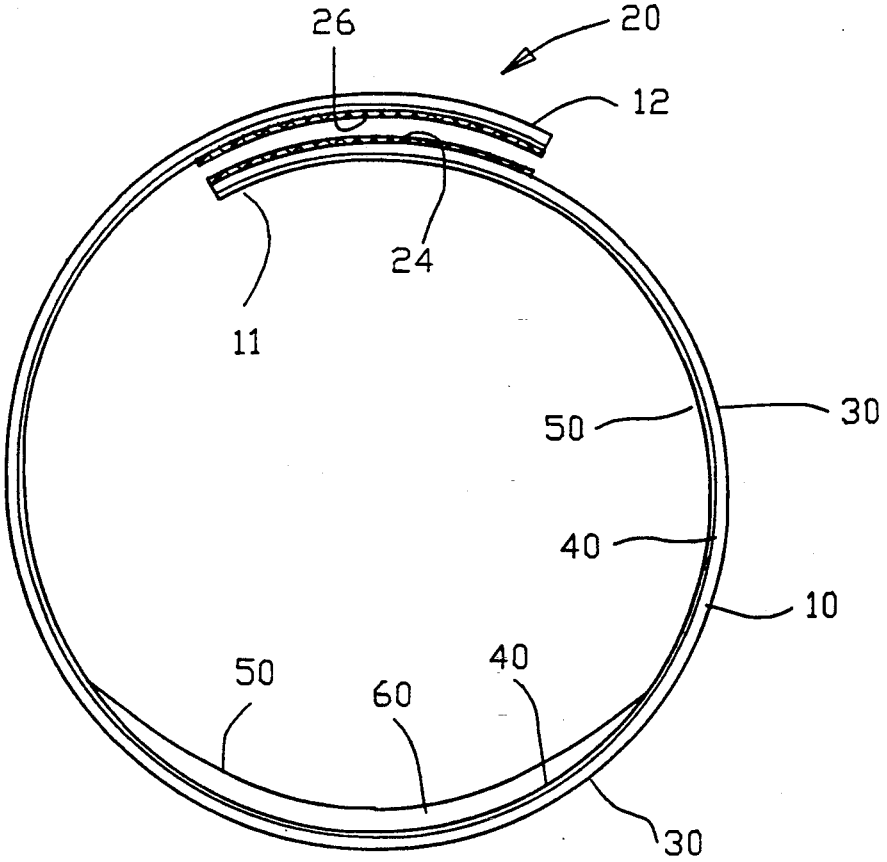
FIG. 2 is a top view of the sweatband of FIG. 1.

FIG. 1 illustrates a headband or a sweatband 10 constructed in accordance with the present invention and being operatively secured to the head 14 of a wearer 13. FIG. 2 is a top view of the sweatband 10 according to the present invention.

Figure 3:
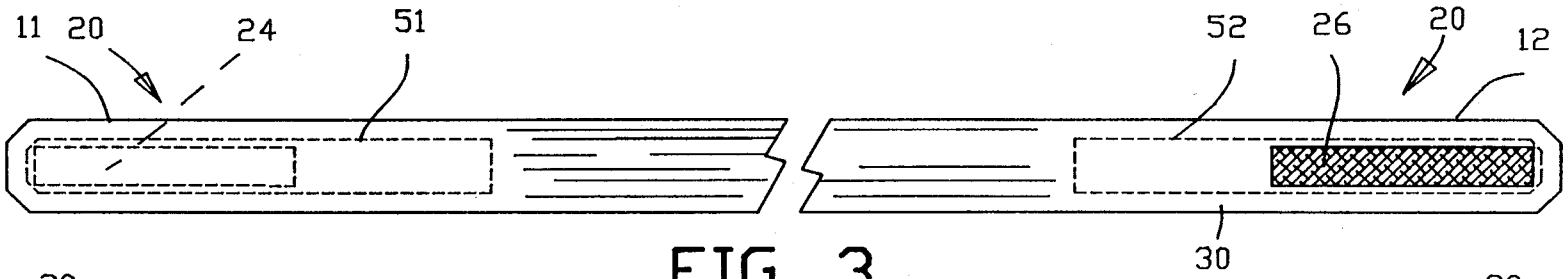
FIG. 3 is front view of the sweatband of FIG. 1.
Figure 4:
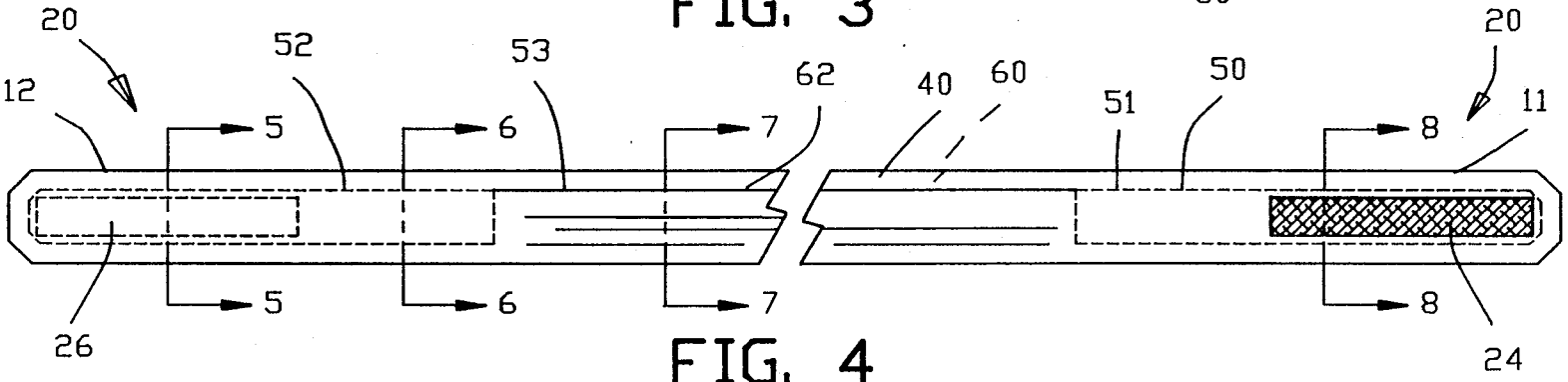
FIG. 4 is a back view of the sweatband of FIG. 1.

FIG. 3 is front view of the headband 10 whereas FIG. 4 is a back view thereof. FIGS. 5–8 are sectional views taken along various portions of FIG. 4.

The sweatband 10 extends between a first end 11 and a second end 12 and comprises a first fabric 30, a second fabric 40, a third fabric 50, a pocket 60 and a removable package 70. The pocket 60, shown in phantom lines, is positioned so as to be in continuous contact with the skin of the forehead 16 during use. The pocket 10 is formed between the second fabric 40 and the third fabric 50 with the pocket 60 being adapted to receive the removable package.

The first fabric 30 is the outer most fabric with the hooks 24 attached to at the first end 11. The second fabric 40 has the loops 26 secured at the second end 12 opposite the first end 31 of the first fabric 30 supporting the hooks 24 in order that the hooks 24 can link with the loops 26 to secure the sweatband to the head 14 of the wearer 13. As should be appreciated by those skilled in the art, the placement of either the hooks 24 or the loops 26 on the first and second ends 11 and 12 not critical as long as both hooks 24 and loops 26 are used in a manner of mutual cooperation.

As best shown in FIGS. 3 and 4, the first fabric 30 has an elongated rectangular shape which is configured to fit about the head 14 of the wearer 13 as best shown in FIG. 1. FIG. 3 illustrates the securing means 20 is illustrated at the loops 26 connected to the first fabric 30 at the first end 11 of the sweatband 10.

FIG. 4 shows the back of the sweatband 10 of the present invention. The pocket 60 is made by partially securing the periphery of the third fabric 50 to the second fabric 40 by seams 51 and 52 located on the first and second ends 11 and 12 of the sweatband 10. The seams 51 and 52 interconnect the first, second and third fabrics 30, 40 and 50 in a conventional manner. The portion 53 of the periphery of the third fabric 50 which is not secured to the second fabric provides forms an opening 62 into the pocket 60. FIG. 3 also illustrates the securing means 20 is illustrated at the hooks 24 connected to the third fabric 30 at the second end 12 of the sweatband 10.

Figure 5:
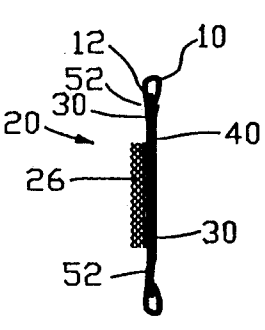
FIG. 5 is a sectional view taken along line 5—5 of FIG. 4.

FIG. 5 is a sectional view taken along line 5—5 of FIG. 4 illustrating the second end 12 of the sweatband 10 with the first fabric 30 secured to the second fabric 40 and third fabric 50 by the seam 52. FIG. 5 further illustrates the loops 26 being connected to the first fabric 30 at the second end 12 of the sweatband 10.

Figure 6:
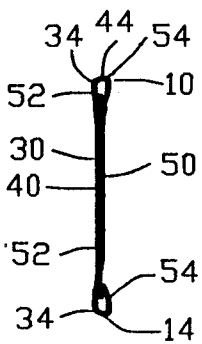
FIG. 6 is a sectional view taken along line 6—6 of FIG. 4.

FIG. 6 is a sectional view illustrating the periphery 34 of the first fabric 30 joined to the periphery 44 of the second fabric 40 and the periphery 54 of the third fabric 50.

Figure 7:
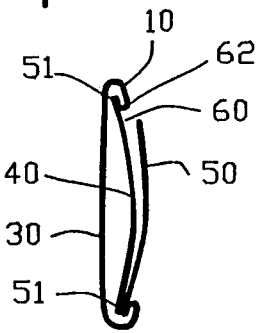
FIG. 7 is a sectional view taken along line 7—7 of FIG. 4.

FIG. 7 is a sectional view showing the periphery 54 of the third fabric 50 secured to the periphery 34 of the first fabric 30 and to the periphery 44 of the second fabric 40, respectively. The opening 62 allows the removable package 70 to be inserted into the pocket 60.

In the preferred embodiment the hooks 24 and loops 26 are positioned on different fabrics with the first fabric 30 having a larger surface area relative to the third fabric 50 and the first, second and third fabrics are stitched or joined as described and illustrated by seams 51 and 52. FIG. 7 illustrates the larger surface area of the first fabric 30 relative to the surface area of the second fabric 40 between the seams 51 and 52. This construction allows for the swelling of the granular material during the absorption of moisture while at the same time maintaining the tension necessary to hold the sweatband to the head of the wearer in a continuously comfortable manner before and during the absorption process which causes the granular material to swell or increase in volume as compare FIGS. 12 and 13, which are discussed below.

Figure 8:
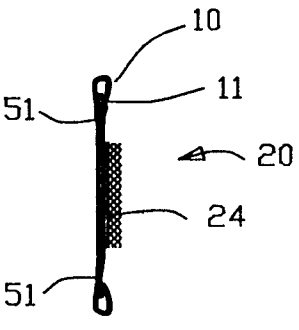
FIG. 8 is a sectional view taken along line 8—8 of FIG. 4.

FIG. 8 is a sectional view illustrating the first end 11 of the sweatband 10 where the hooks 24 are secured to the third fabric 50.

Figure 9:
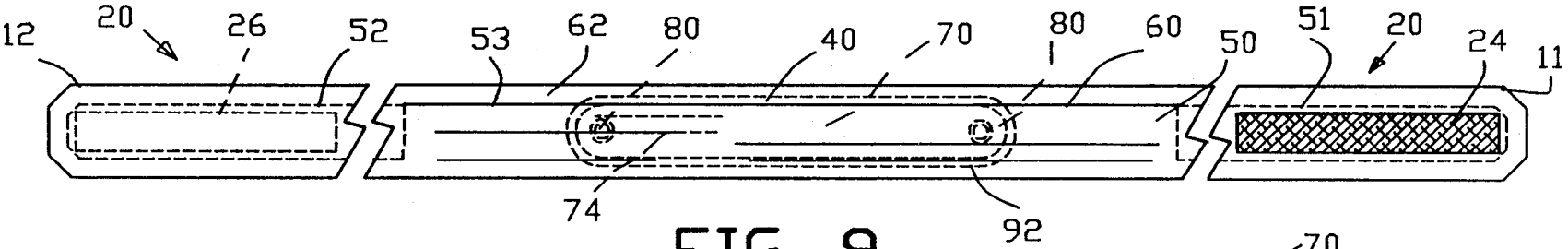
FIG. 9 is a back view of the sweatband of FIG. 1 with the removable package shown in phantom.

FIG. 9 is a back view of the present invention with the removable package 70 extending between a first and a second end 71 and 72 as shown in phantom lines inserted into the pocket 60. The removable package 70 contains a polymeric moisture absorbing material 74 which is normally is a powder but which changes into a gel upon the absorption of moisture. The granular moisture absorbing material 74 is preferably hydrophilic polymer granules such as the product available under the trademark "TERRA*SORB" through Industrial Services International, Inc. of Bradenton, Florida.

Figure 10:
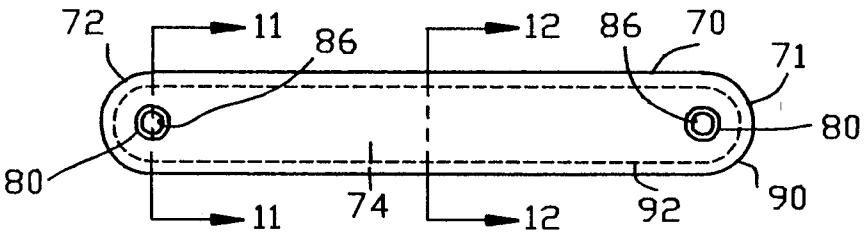
FIG. 10 is a front view of the removable package.

FIG. 10 shows the front view of the removable package 70 with grommets 80 for hanging the removable package 80 positioned at the first and second end 71 and 72 of the removable package 70. The removable package is composed of a fourth fabric 90 which is water permeable to allow the sweat generated during exercise to pass into the granular moisture absorbing material. The granular moisture absorbing material 74 is contained within two layer of the fourth fabric 90 by a seam 92.

Figure 11:
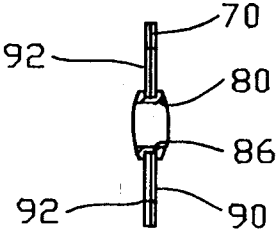
FIG. 11 is a sectional view taken along line 11—11 of FIG. 10 illustrating a hanging means shown as grommets.

FIG. 11 is a sectional view illustrating the grommet 80 which have an aperture 86 formed therein for receiving a hook or the like to hold the package 70 during regeneration of the granular material 74. The grommets 80 also allow for the attachment of a string (not shown) to package 70 which may be used to dry and regenerate the granular moisture absorbing material 74.

Figure 12:
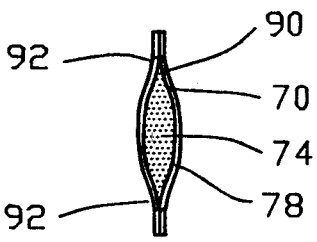
FIG. 12 is a sectional view taken along line 12—12 of FIG. 10 illustrating dry polymeric moisture absorbing material.

FIG. 12 is a sectional view of the removable package 70 illustrating dry 78 polymeric moisture absorbing material 74.

Figure 13:
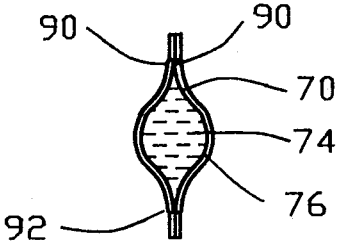
FIG. 13 a sectional view similar to FIG. 12 illustrating the polymeric moisture absorbing material in a saturated condition.

FIG. 13 illustrates the removable package 70 with the polymeric moisture absorbing material 74 in a saturated 76 condition.

Preferably, the first fabric 30 is made of a water impermeable material such as coated nylon for providing an attractive outer cover and for retaining the moisture within the second fabric 30, the third fabric 40 and the fourth fabric 90. The second fabric 30, the third fabric 40 and the fourth fabric 90 are made of a water permeable fiber such as cotton. Accordingly, moisture may migrate from different locations of the second fabric 30 and the third fabric 40 to enter the fourth fabric 90 and be absorbed by the moisture absorbing material 74.

Figure 14:
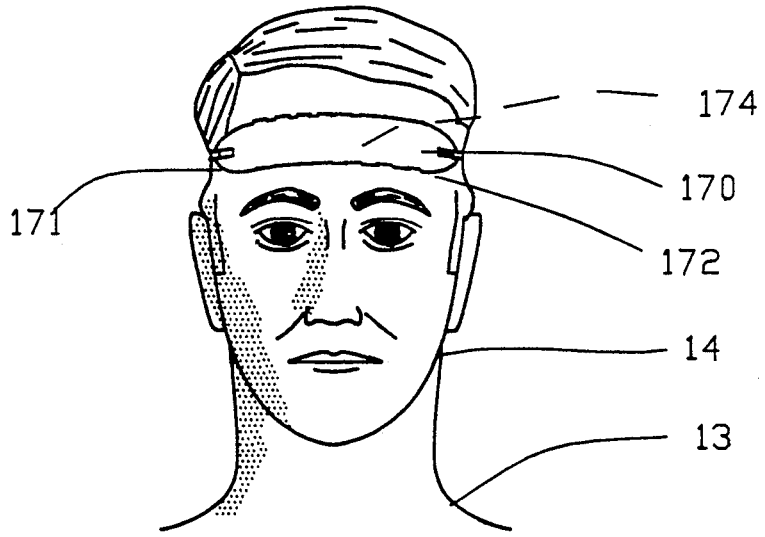
FIG. 14 illustrates a second embodiment of the present invention illustrating the removable package being directly secured to the head of a wearer.

FIG. 14 illustrates a second embodiment of the present invention illustrating a removable package 170 being directly secured to the head 14 of the wearer 13. In this embodiment the removable package 170 extending between a first and a second end 171 and 172. The removable package 170 contains a polymeric moisture absorbing material 174 which is normally is a powder but which changes into a gel upon the absorption of moisture. The granular moisture absorbing material 174 is preferably hydrophilic polymer granules such as the product available under the trademark "TERRA*-SORB" through Industrial Services International, Inc. of Bradenton, Florida.

Figure 15:
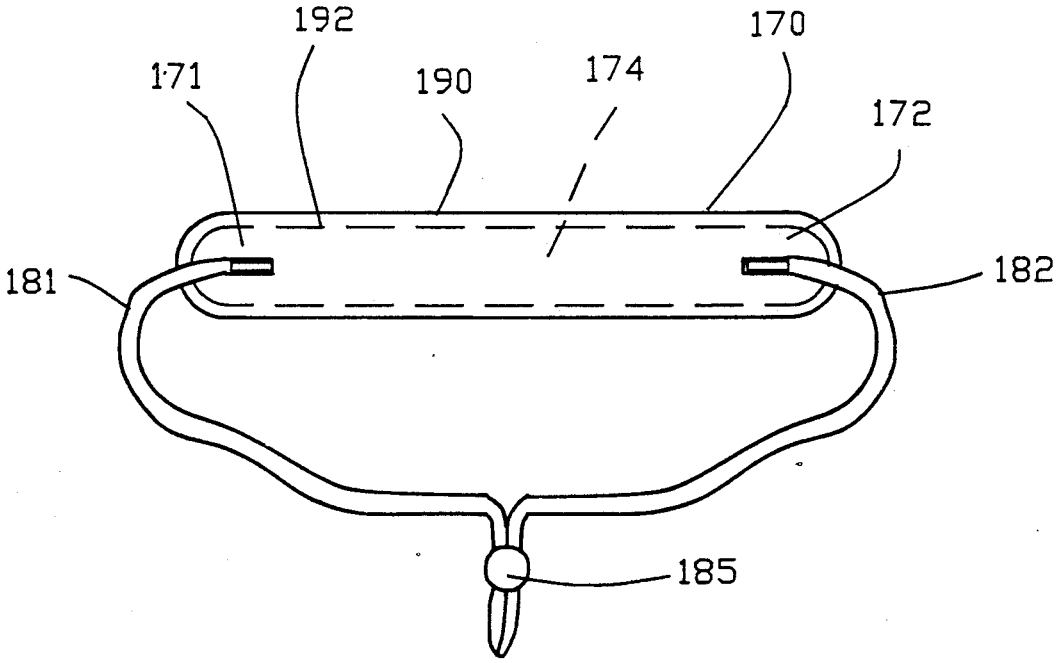
FIG. 15 is front view of the sweatband of FIG. 14.

FIG. 15 shows the front view of the removable package 170 with strings 181 and 182 secured to the first and second ends 171 and 172 of the removable package 170. An adjustable bead 185 is movable upon the strings 181 and 182 to secure the removable package 170 to the head 14 of the wearer 13 as shown in FIG. 12.

The removable package is composed of a fourth fabric 190 which is water permeable to allow the sweat generated during exercise to pass into the granular moisture absorbing material. The granular moisture absorbing material 174 is contained within two layer of the fourth fabric 190 by a seam 192.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A sweatband comprising:

a liquid impermeable first fabric having an elongated rectangular shape configured to fit about the head of a wearer and having a periphery;

a liquid permeable second fabric having an elongated rectangular shape configured to fit about the head of the wearer and having a periphery with said periphery of said second fabric attached to said periphery of the first fabric;

a liquid permeable third fabric having an elongated rectangular shape configured to extend along the forehead of a wearer and having a periphery partially secured to said second fabric thereby forcing a pocket having an opening to permit access into said pocket;

securing means for securing in use said fabrics to the head of the wearer such that one of said first and said third fabrics is pressed against the forehead of the wearer by tension generated by said securing means; and a removable package for holding granular moisture absorbing material and having an elongated rectangular shape configured to fit within said pocket such that upon saturation of said granular moisture absorbing material with absorbed moisture, said package may be removed from said pocket by way of said opening to enable said granular moisture absorbing material to be dried and to permit replacement of said removable package with a removable package having dry granular moisture absorbing material.

2. The headband of claim 1 wherein said first and said second fabrics are cotton.

3. The sweatband of claim 1 wherein said securing means is hooks and loops.

4. The sweatband of claim 1 wherein said removable package further includes hanging means for suspending said package in order to allow said granular material to air-dry.

5. The sweatband of claim 1 wherein said granular moisture absorbing material is hydrophilic polymer granules.

6. A sweatband comprising:

a liquid impermeable first fabric having an elongated rectangular shape configured to fit about the head of a wearer and having a periphery;

a liquid permeable second fabric having an elongated rectangular shape configured to fit about the head of the wearer with said second fabric attached to said periphery of the first fabric;

a liquid permeable third fabric having an elongated rectangular shape configured to extend along the forehead of a wearer and having a periphery partially secured to said second fabric thereby forming a pocket having an opening to permit access into said pocket;

securing means for securing in use said fabrics to the head of the wearer such that one of said first and said third fabric is pressed against the forehead of the wearer by tension generated by said securing means;

a removable package for holding hydrophilic polymeric granules for absorbing moisture and having an elongated rectangular shape configured to fit within said pocket such that upon saturation of said granular polymeric material with absorbed moisture, said package may be removed from said pocket by way of said opening to enable said granular polymeric material to be dried and to permit replacement of said removable package with a removable package having dry granular polymeric material; and said removable package further includes hanging means for suspending said package in order to allow said granular material to air-dry.

7. The sweatband of claim 1 wherein said securing means is hooks and loops.

8. A sweatband comprising:

a first elongated rectangular fabric configured to fit about the head of a wearer and having a periphery enclosing a surface area;

a second elongated rectangular fabric configured to fit about the head of the wearer and having a periphery enclosing a surface area which is less than said surface area of said first fabric with said periphery of said second fabric attached to said periphery of said first fabric;

a third fabric having an elongated rectangular shape configured to extend along the forehead of a wearer and having a periphery partially secured to said second fabric thereby forming a pocket having an opening to permit access into said pocket;

a removable package for holding granular moisture absorbing material and having an elongated rectangular shape configured to fit within said pocket such that upon saturation of said granular moisture absorbing material with absorbed moisture, said package may be removed from said pocket by way of said opening to enable said granular moisture absorbing material to be dried and to permit replacement of said removable package with a removable package having dry granular moisture absorbing material;

securing means for securing in use said fabrics to the head of the wearer comprising hooks and loops, with one of said hooks and loops being operatively positioned on said first fabric and the remaining one of said hooks and loops being operatively positioned on said second fabric; and said surface area of said second fabric being less than said surface area of said first fabric for permitting swelling of said granular material during absorption of moisture while maintaining the tension necessary to hold the sweatband to the head of the wearer in a continuously comfortable manner before and during the absorption process.

* * * * *